United States Patent [19]

Ehara et al.

[11] Patent Number: 4,687,724

[45] Date of Patent: Aug. 18, 1987

[54] PHOTORECEPTOR FOR ELECTROPHOTOGRAPHY COMPRISING BORON DOPED A-$SI_{1-x}N_x$:H:F

[75] Inventors: Shaw Ehara, Tenri; Yoshimi Kojima; Eiji Imada, both of Nara; Takashi Hayakawa; Toshiro Matsuyama, both of Tenri, all of Japan

[73] Assignee: Sharp Kabushiki, Osaka, Japan

[21] Appl. No.: 561,349

[22] Filed: Dec. 14, 1983

[30] Foreign Application Priority Data

Dec. 16, 1982 [JP] Japan ..... 57-221642

[51] Int. Cl.[4] ..... G03G 5/082

[52] U.S. Cl. ..... 430/84; 430/95; 430/128

[58] Field of Search ..... 430/84, 128, 95; 252/501.1; 423/344

[56] References Cited

U.S. PATENT DOCUMENTS

| | | | |
|---|---|---|---|
| 4,409,308 | 10/1983 | Shimizu et al. | 430/84 |
| 4,418,132 | 11/1983 | Yamazaki | 430/84 |
| 4,483,911 | 11/1984 | Ogawa et al. | 430/65 |

*Primary Examiner*—John L. Goodrow

*Attorney, Agent, or Firm*—Birch, Stewart, Kolasch and Birch

[57] ABSTRACT

A photoreceptor for electrophotography utilizing a-Si:N:H:F, wherein a stable high-sensitive layer is provided and the time-lapse variation in characteristics is reduced in the use of an a-$Si_{1-x}N_x$ layer as a sensitive layer.

20 Claims, 4 Drawing Figures

ρdark (Ωcm)
SiH4 / SiH4+SiF4 = 95%
10^13
10^12
10^11
10^10
10^9
10^8
10^7
500
3000
10000
B2H6 → ppm
○ : NH3=30%
△ : " 15%
× : " 5%

ρdark (Ωcm)
SiH4 / SiH4+SiF4 = 90%
10^13
10^12
10^11
10^10
10^9
10^8
10^7
500
3000
10000
B2H6 → ppm
○ : NH3=30%
△ : " 15%
× : " 5%

ρdark (Ωcm)
SiH4 / SiH4+SiF4 = 70%
10^13
10^12
10^11
10^10
10^9
10^8
10^7
500
3000
10000
B2H6 → ppm
○ : NH =30%
△ : " 15%
× : " 5%

PHOTORECEPTOR FOR ELECTROPHOTOGRAPHY COMPRISING BORON DOPED A-$SI_{1-x}N_x$:H:F

BACKGROUND OF THE INVENTION

1. Field of the Invention

The present invention relates to a sensitive body, for electronic photograph use, using amorphous silicon, and, more particularly, to a photoreceptor for electrophotography utilizing a-Si:N:H:F.

2. Description of the Prior Art

Materials such as amorphous selenium (a-Se) or compositions of resin with cadmium sulfide being dispersed therein have been most commonly used as a photoreceptor for electrophotography. However, the former photoreceptor of amorphous selenium is vulnerable to heat or mechanical impacts so that the surfaces thereof might be easily broken or deteriorate and thereby lose sensitivity. Also, both the photoreceptors of amorphous selenium and cadmium sulfide are not mechanically solid and do not have a long service life. In addition, the materials such as being Se, Cd are well known as poisonous and harmful to the health.

Recently amorphous silicon (a-Si) has drawn attention as a material for an ideal photoreceptor which can eliminate the above disadvantages of the conventional ones, since it is considered to be highly sensitive, extremely solid, and pollution free. Particularly, a-Si:H whose unsaturated chemical bond, so called dangling bond, is terminated with hydrogen, can be doped into, a p or n type semiconductor, so that various superior electric characteristics are provided. Therefore, the a-Si is used not only as a photoreceptor, but also as a material for the other electronic components.

Some excellent characteristics can be expected from the a-Si whose dangling bond is terminated with hydrogen described hereinabove, but it can not be put into practical use, because the bond between hydrogen and silicon is so weak that some of the hydrogen is evolved by irradiation of light and heat, thus resulting in deteriorated characteristics for the material.

An amorphous silicon:H:F layer is proposed, to which fluorine has been added beside hydrogen for termination of the dangling bond. In an experiment, it is confirmed that the thin film is more stable than amorphous silicon :H while retaining almost the same optical sensitivity.

However the a-Si:H:F layer can not acquire high resistivity in the order of $10^{13}$ Ωcm which, at present, is necessary for a photoreceptor of electrophotography. Also, the sufficient resistivity thereof can not be acquired even if compensated for by the addition of boron such dopants.

On the other hand, it has recently been proposed to provide the structure of a photoreceptor consisting of amorphous silicon with an electric blocking layer of a-SiN which is inserted between the a-Si:H layer and a conductive substrate in order to retain the surface potential. Also, the material of a-$Si_{1-x}N_x$:H, wherein x is rather small, with a small amount of boron, is also proposed to be utilized as photosensitive layer. When these photoreceptors described hereinabove were tested in the conventional electrophotographic process in laboratory, the initial characteristics of the photoreceptor was satisfactorily attained, but it was found that the surface charging potential was reduced to half after about two to three weeks.

Such deterioration of the surface charging potential was observed almost equal to that of the boron added a-Si:H photoreceptor which was not passivated by the nitrogen. These observations should be understood as the result of the evolution of hydrogen which was put into the material to terminate the dangling bond. In the case of the a-SiN, it is considered that nitrogen has a tendency to form a nitrogen silicon compound, instead of a mere terminator, so that the dangling bond caused due to the amorphous state is mainly terminated by hydrogen. However, as described hereinabove, the termination of the dangling bond by the hydrogen is insufficient and the aging deterioration thereof cannot be avoided.

SUMMARY OF THE INVENTION

An object of the present invention is to provide a photoreceptor for electrophotography, which can eliminate the disadvantages inherent in the conventional one as referred to above, wherein a stable high photosensitive layer is provided and an a-SIN layer is introduced as a photoreceptor layer to reduce the aging deterioration in its characteristics.

Another object of the present invention is to provide a photoreceptor for electrophotography, which utilizes the good charge retention characteristics of a-$Si_{1-x}N_x$, whereby the stable dark resistivity characteristics can be provided for a long period of time, and the photoreceptor with amorphous film can be put into practical use.

A still further object of the present invention is to provide a photoreceptor for electrophotography, wherein nitrogen should be considered to have bonds not only with the silicon dangling bonds but also with silicon, hydrogen and fluorine to form an amorphous network, and fluorine should be considered to have bonds only with the silicon dangling bonds, thus making the photoreceptor more stable than the one made of silicon, nitrogen and hydrogen.

According to the present invention, there is provided a photoreceptor for electrophotography comprising a substrate of conductor and an amorphous silicon film formed on the substrate, the amorphous silicon of said film being composed of a-$Si_{1-x}N_x$ containing nitrogen and boron doped to said a-$SI_{1-x}N_x$, in which hydrogen and fluorine are adapted to stabilize the unsaturated coupling to be disposed among them.

In a preferred embodiment, the photoreceptor for electrophotography of the type referred to above is provided in that said nitrogen is added due to decomposition of ammonia gas into which $NH_3/[SiH_4+SiF_4]$ has been flowed at the rate of 5 through 30%, boron is fed with diborane to which $B_2H_6$ has been flowed at the concentration of 500 ppm through 10,000 ppm.

These and other objects, features, aspects and advantages of the present invention will become more apparent from the following detailed description of the present invention when taken in conjunction with the accompanying drawings.

DESCRIPTION OF THE PREFERRED EMBODIMENT

According to the present invention, boron is firstly added to the a-$Si_{1-x}N_x$:H containing nitrogen which has been provided, and, then, fluorine element, together with hydrogen, is added to it. It is produced on the a-$Si_{1-x}N_x$:H:N conductor for use as a photoreceptor for electrophotography.

Figure 2:
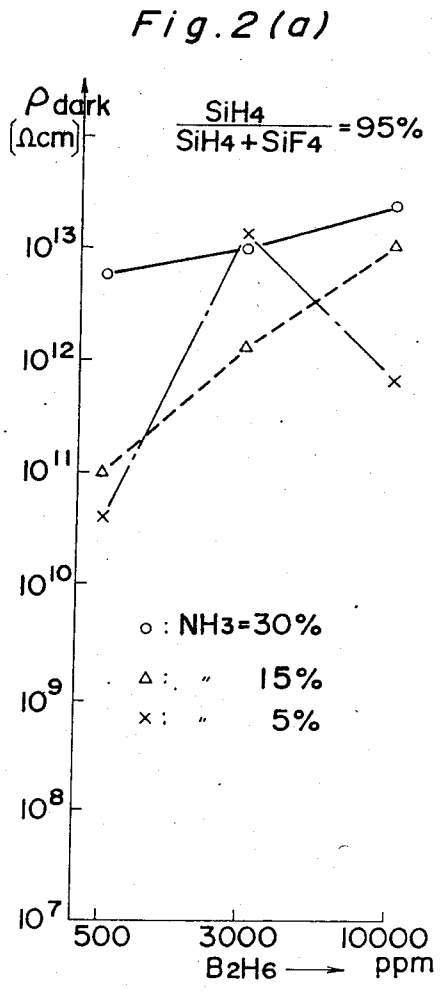
FIGS. 2(*a*) through (*c*), are graphs each showing the relationship between the mixture ratio of raw-material gas of the present invention and the dark resistance thereof.
Figure 2:
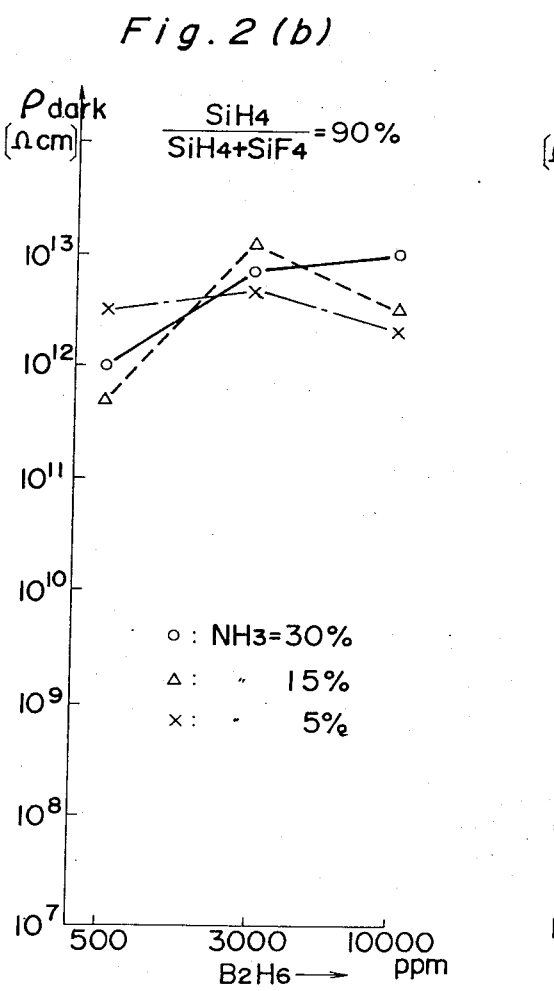
Figure 2:
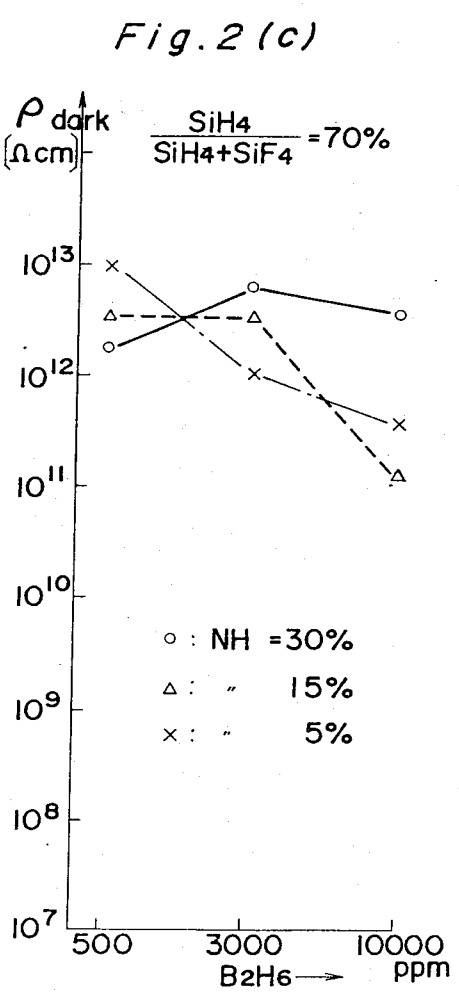

The effect on the resistivity of a-$Si_{1-x}N_x$:H:F by introducing boron is shown in FIGS. 2(*a*) to (*c*), of which the abscissas shows the boron content.

Figure 1:
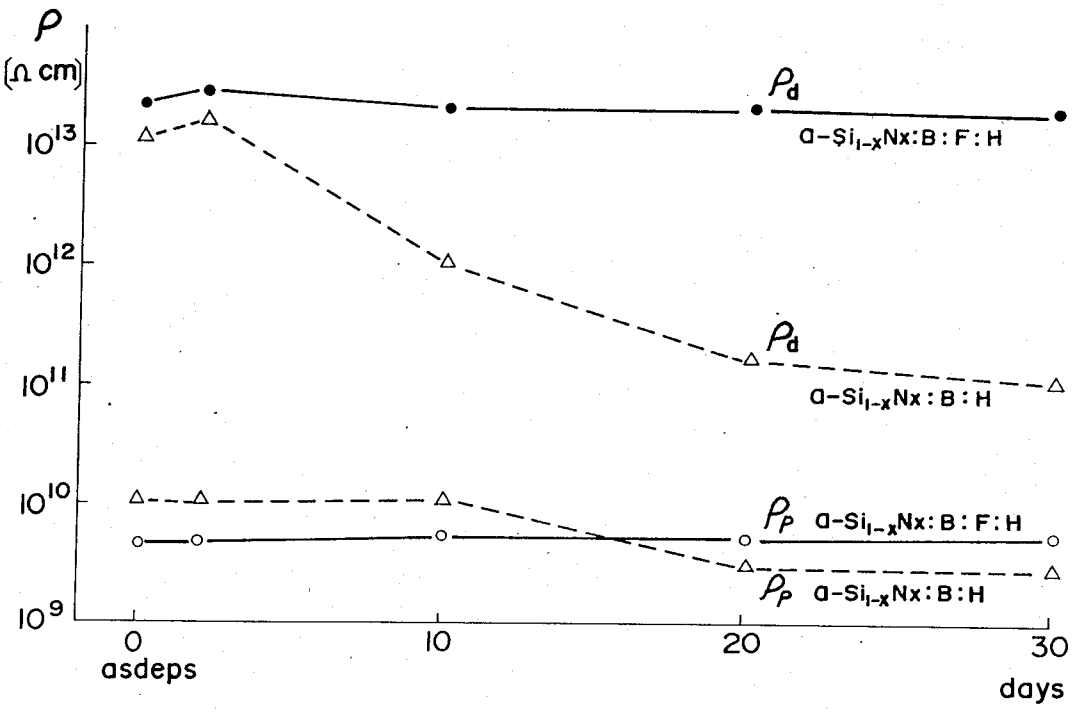
FIG. 1 is a graph showing the comparison in time-lapse variation of the specific resistance between the photoreceptor of the present invention and the conventional sensitive body.

The main feature of this photoreceptor is the a-$Si_{1-x}N_x$ constituent in which dangling bonds are terminated together with hydrogen and also fluorine. As shown in FIG. 1, by introducing boron a sufficiently high resistivity necessary for a photoreceptor of an electrophotograph can be obtained.

A method of manufacturing the boron doped a-$Si_{1-x}N_x$:H:F photoreceptor will be concretely described hereinafter in one embodiment. An aluminum substrate, formed of a conductive base plate, is set within a reaction chamber of a capacitive type GD-CVD apparatus and the substrate is heated by a heater at a temperature of 250° C. to 300° C. Then, the raw-material gases are fed into a reaction chamber to form a-$Si_{1-x}N_x$:H:F thin film containing boron. The types and mixture ratio of gases to be mixed within the raw-material gases are determined in such a manner that nitrogen and fluorine are introduced into the reaction chamber respectively in the form of ammonia ($NH_3$) gas and of silicon tetrafluoride ($SiF_4$), and, in case that the gas flow ratio of monosilane ($SiH_4$) and silicon tetrafluoride ($SiF_4$) is set by a condition of $SiH_4$:$SiF_4$=9:1, the gas flow ratio of the $NH_3$ gas is determined by the relationship of formula such that $NH_3/[SiH_4\ (90\%)+SiF_4\ (10\%)]=15\%$, and, furthermore, boron ($B_2H_6$) is added to them by the ratio of formula such that $B_2H_6/[SiH_4\ (90\%)+SiF_4\ (10\%)]=3{,}000$ ppm. It is to be noted that, keeping the gas flow ratio as described hereinabove, the total gas flow is set to be 200 sccm.

These raw-material gases are introduced into the reaction chamber and are glow-discharged under the conditions of 13.56 MHz in RF frequency, 200 W in output power and 0.1 Torr in gas pressure, to thereby cause a plasma. The a-$Si_{1-x}N_x$:H:F thin film of approximately 1 μm can be made for about one hours plasma to be produced under the above described discharge conditions.

The dark and photo (or bright) resistivities of the a-$Si_{1-x}N_x$:H:F film made under the above described conditions are $2\times10^{13}$ Ωcm and $5\times10^{9}$ Ωcm respectively, wherein the photo resistivity is measured under the irradiation of 610 nm light with the intensity of 10 μW/cm$^2$. The film described above also shows superior characteristics as photoreceptor.

Also, the aging characteristics of the photoreceptor made under the condition described above is shown in FIG. 1, in which, for comparison, the aging characteristics of the a-$Si_{1-x}N_x$(B):H thin film, which is free from fluorine, is also shown. In FIG. 1, the solid line shown the variation of the photoreceptor made under the above described condition with the embodiment of the present invention, while the broken line shows the variation of the conventional photoreceptor not stabilized by fluorine, wherein a reference of $\rho_d$ shows the variation of the dark resistivity and $\rho_p$ shows the variation of the photo resistivity.

As clearly shown in FIG. 1, the a-$Si_{1-x}N_x$(B):H film of the conventional photoreceptor which is free from fluorine deteriorates in the dark resistivity by about two order of magnitude in about one month, but the fluorine containing a-$Si_{1-x}N_x$(B):H:F film of the embodiment of the present invention does not deteriorate by any means.

The above described embodiment is one example of the case employing the raw-material gases which includes 3000 ppm of $B_2H_6$ gas and 15% of $NH_3$ gas, wherein the incorporation of nitrogen into the film due to the decomposition of the ammonia gas and of boron into the film due to the decomposition of the diborane gas are closely interrelated. The mutual relationship among Si, N, B, H, F is shown in FIGS. 2(*a*) through (*c*) of three cases in which silicon tetrafluoride ($SiF_4$) is mixed with monosilane ($SiH_4$) in three experiments each having the relation of $SiH_4/(SiH_4+SiF_4)=95\%$ (a), 90% (b), and 70% (c), respectively. In each experiment, the mixing ratio of ammonia gas ($NH_3$) and diborane gas ($B_2H_6$) was adapted to vary at 5 through 30% and 500 to 10,000 ppm respectively.

As shown in FIGS. 2(*a*) through (*c*), by some choices of the gas mixing ratio, it is possible to have the film whose dark resistivity is as high as $10^{13}$ Ωcm and is high enough for use as photoreceptor. Also, the photoreceptor having the resistivity of as high as $10^{13}$ Ωcm shows very little aging variation and stable operation.

In the above described embodiment of thin film, nitrogen should be considered to have bonds not only with silicon dangling bonds but also with silicon, hydrogen and fluorine to form an amorphous network, and fluorine should be considered to have bonds only with silicon dangling bonds, thus making the photoreceptor more stable than the conventional one made of silicon, nitrogen and hydrogen. According to the present invention, within the photoreceptor utilizing the good charge retention characteristics of a-$Si_{1-x}N_x$, the stable dark resistivity characteristics can be provided for a long period of time, and the photoreceptor with amorphous film can be put into practical use.

Although the present invention has been described and illustrated in detail, it is to be clearly understood that the same is by way of illustration and example only and is not to be taken by way of limitation, the spirit and scope of the present invention being limited only the terms of the appended claims.

What is claimed is:

1. A photoreceptor for electrophotography comprising a substrate of conductor and a single layer of amorphous silicon film formed on the substrate, said amorphous silicon of said film being composed of a-$Si_{1-x}N_x$ containing nitrogen and boron doped to said a-$Si_{1-x}N_x$, in which the silicon dangling bonds are terminated with hydrogen and fluorine.

2. The photoreceptor for electrophotography as defined in claim 1, wherein said nitrogen is added due to decomposition of ammonia gas by the flow of $NH_3/[SiH_4+SiF_4]$ at the rate of 5 through 30%, and boron is fed with diborane by the flow of $B_2H_6$ at the concentration of 500 ppm through 10,000 ppm.

3. A method for producing a photoreceptor for electrophotography of amorphous silicon film-formed on a conductor, said amorphous silicon being composed of a-$Si_{1-x}N_x$ containing nitrogen and boron, the improvement thereof comprising the steps of adding said nitrogen into said a-$Si_{1-x}N_x$ due to decomposition of ammonia gas into which the flow of $NH_3/[SiH_4+SiF_4]$ has been flowed at the rate of 5 through 30%, and feeding said boron with diborane to which $B_2H_6$ has been flowed at the concentration of 500 ppm through 10,000 ppm.

4. A photoreceptor for electrophotography comprising a conductive substrate and a single layer of amorphous silicon film disposed thereon, said amorphous silicon film being comprised of a-$Si_{1-x}H_x$ containing nitrogen and boron doped to said a-$Si_{1-x}N_x$ and wherein at least a portion of the silicon dangling bonds are terminated with fluorine.

5. A photoreceptor for electrophotography comprising a conductive substrate and a single layer of amorphous silicon film disposed thereon, said film being comprised of a boron doped a-$Si_{1-x}N_x$:H:F wherein said nitrogen is bonded with silicon, hydrogen and fluorine to form an amorphous network and said fluorine is bonded only with the silicon dangling bonds.

6. A method for producing a single layer photoreceptor of a boron doped a-$Si_{1-x}N_x$:H:F comprising introducing $NH_3$, $SiF_4$, $SiH_4$ and $B_2H_6$ gases into a reaction chamber containing a conductive substrate said gases being flowed at rates to satisfy the relationships of:

(a) $NH_3/[SiH_4+SiF_4]=5$ to 30%; and (b) the flow of $B_2H_6=500$ to 10,000 ppm.

7. A method according to claim 6, wherein the ratio of $SiH_4:SiF_4=9:1$, said relationship $NH_3/[SiH_4+SiF_4]=15\%$ and $B_2H_6$ is flowed at a rate of 3,000 ppm.

8. A method according to claim 6, wherein said gases are introduced into said reaction chamber and glow discharged under the conditions of 13.56 MHz in RF frequency, 200 W in output power and 0.1 Torr in gas pressure.

9. A method according to claim 6, wherein the total gas flow is 200 sccm.

10. A method according to claim 6, wherein prior to introduction of said gases, said substrate is heated in said reaction chamber to a temperature of 250° to 300° C.

11. A method according to claim 6, wherein the ratio of $SiH_4:SiF_4$ is 2.33:1 to 19:1.

12. A method for producing a single layer photoreceptor of a boron doped a-$Si_{1-x}N_xH$:F comprising introducing $NH_3$, $SiF_4$, $SiH_4$ and $B_2H_6$ gases into a reaction chamber containing a conductive substrate said gases being flowed at rates to satisfy the relationships of:

(a) $SiH_4:SiF_4=2.33:1$ to 19:1;

(b) $NH_3/[SiH_4+SiF_4]=5$ to 30%;

(c) The flow of $B_2H_6=500$ to 10,000 ppm; and (d) The total gas flow is 200 sccm.

13. A method according to claim 12, wherein the ratio of $SiH_4:SiF_4=9:1$, said relationship $NH_3/[SiH_4+SiF_4]=15\%$, said $B_2H_6$ is flowed at a rate of 3,000 ppm, and said gases are introduced into said reaction chamber and glow discharged conditions sufficient to cause a plasma.

14. A method according to claim 13, wherein said glow discharge conditions are such that the RF frequency is 13.56 $MH_2$, the output power is 200 W and the gas pressure is 0.1 Torr.

15. The photoreceptor according to claim 1 having a dark resistivity of at least $10^{13}$ Ωcm.

16. A photoreceptor produced by the process according to claim 6 having a dark resistivity of $2\times10^{13}$ Ωcm and a photo (or bright) resistivity of $5\times10^9$ Ωcm, said photoresistivity being measured under irradiation of 610 nm light of intensity of 10 $\mu W/cm^2$.

17. A photoreceptor produced by the process according to claim 7 having a dark resistivity of at least $10^{13}$ Ωcm.

18. A phtoreceptor produced by the process according to claim 7 having a dark resistivity of $2\times10^{13}$ Ωcm and a photo (or bright) resistivity of $5\times10^9$ Ωcm and a photo (or bright) resistivity of $5\times10^9$ Ωcm, said photoresistivity being measured under irradiation of 610 nm light of intensity of 10 $\mu w/cm^2$.

19. A photoreceptor produced by the process according to claim 12 having a dark resistivity of at least $2\times10^{13}$ Ωcm.

20. A photoreceptor produced by the process according to claim 12 having a dark resistivity of $2\times10^{13}$ Ω/cm and a photo (or bright) resistivity of $5\times10^9$ Ωcm, said photoresistivity being measured under irradiation of 610 nm light of intensity of 10 $\mu W/cm^2$.

* * * * *